United States Patent [19]

Potter et al.

[11] 4,107,573

[45] Aug. 15, 1978

[54] PRINTED CIRCUIT TRAVELING WAVE TUBE

[75] Inventors: Bobby R. Potter, Richardson, Tex.; Allan W. Scott, Los Altos, Calif.

[73] Assignee: The United States of America as represented by the Secretary of the Army, Washington, D.C.

[21] Appl. No.: 773,563

[22] Filed: Feb. 2, 1977

[51] Int. Cl.[2] ..... H01J 25/34

[52] U.S. Cl. ..... 315/3.5; 315/3.6; 315/39.3

[58] Field of Search ..... 315/3.5, 3.6, 39.3

[56] References Cited

U.S. PATENT DOCUMENTS

| | | | |
|---|---|---|---|
| 3,610,999 | 10/1971 | Falge | 315/3.5 |
| 3,670,197 | 6/1972 | Unger | 315/3.5 |
| 3,736,534 | 5/1973 | Chaffee | 315/3.5 |
| 3,787,747 | 1/1974 | Scott | 315/3.5 |

*Primary Examiner*—Saxfield Chatmon, Jr.
*Attorney, Agent, or Firm*—Nathan Edelberg; Jeremiah G. Murray; Edward Goldberg

[57] ABSTRACT

Undesired oscillations are suppressed in high-power, high-frequency, multiple meanderline printed circuit traveling wave tubes. $\pi$ point frequency oscillations of various modes are attenuated by providing resistive coated longitudinal gaps in the ground plane conductor. The gaps permit lower radio frequency currents to propagate along the length of the line while blocking transverse currents of higher $\pi$ mode frequencies. The resistive coatings and spacing of the gaps control losses while permitting improved operation at the desired frequency. Increased beam current is produced at the output collector due to elimination of oscillations.

6 Claims, 6 Drawing Figures

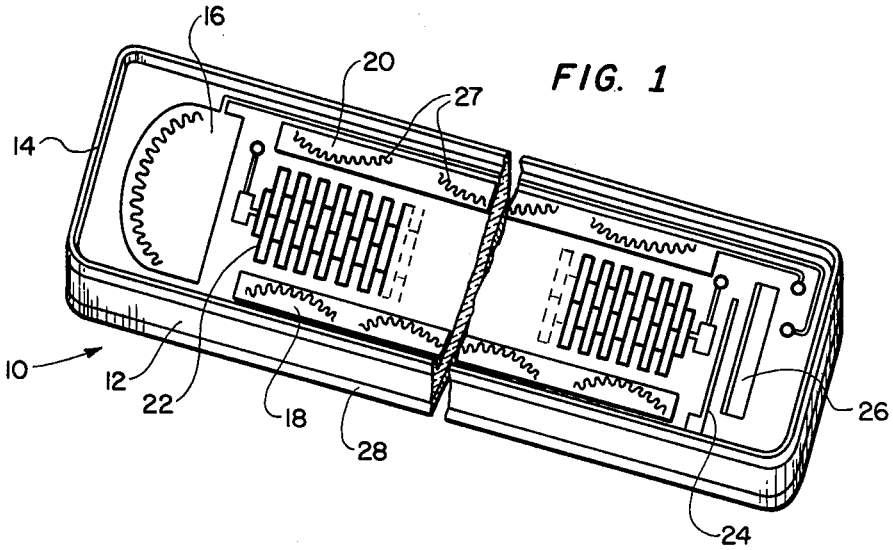
FIG. 1
FIG. 2
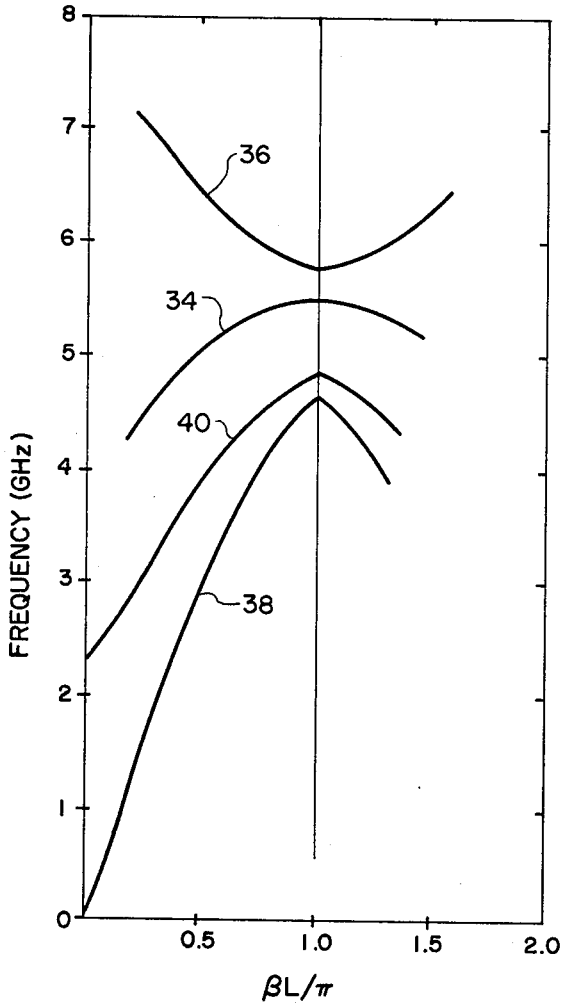

PRINTED CIRCUIT TRAVELING WAVE TUBE

BACKGROUND OF THE INVENTION

This invention relates to multiple meanderline printed circuit traveling wave tubes and particularly to suppression of undesired oscillations therein.

DESCRIPTION OF THE PRIOR ART

Printed circuit traveling wave tubes utilizing multiple slow wave interaction meanderline microstrip circuits have been used for multi-element, high-frequency, high-power phased array radars and other devices where large numbers of identical tubes are required at low cost. These tubes employ electron beam forming and edge focusing electrodes, a microwave interaction structure, a collector, and connections, which are printed on the inner surfaces of a pair of ceramic sheets or substrates. These sheets, with an inner spacing ring or frame, form the vacuum envelope. A flat sheet beam of electrons emitted from a non-printed strip cathode is focused onto the collector by a pair of permanent periodic sheet magnets mounted on the outer surfaces of the ceramic envelope. Such tubes are described in U.S. Pat. No. 3,787,747, issued Jan. 22, 1974 to Allan W. Scott, one of the present inventors, and in an article entitled "High Power Printed Circuit Traveling Wave Tubes", by B. R. Potter, A. W. Scott and J. J. Tancredi, the first two being the joint inventors of the present invention, published in the Technical Digest, 1973 International Electron Devices Meeting of the Institute of Electrical and Electronic Engineers, held on Dec. 5, 1973.

While it has been found that multiple meanderline interaction circuits extend the power and frequency capabilities of printed circuit traveling wave tubes, at certain high beam currents, oscillations occur at particular $\pi$ point frequencies which defocus the beam. This limits the current transmitted to the collector and degrades the performance of the tube. Proposals to suppress such oscillations have included the addition of circuit attenuation elements to provide losses at the individual oscillating frequencies. This effect may be accomplished by use of a plurality of coupled cavities which absorb particular undesired frequencies. Such solutions however, are relatively complex, costly and do not provide optimum results.

SUMMARY OF THE INVENTION

It is therefore the primary object of the present invention to provide a simplified efficient device which can suppress a plurality of undesired $\pi$ point frequency oscillations in a multiple meanderline printed circuit traveling wave tube.

This is achieved by the provision of resistive coated longitudinal gaps in the ground plane outer conductors parallel to the inner multiple circuit meanderline strips on opposite surfaces of each dielectric sheet of the tube envelope. The resistance attenuates high frequency $\pi$ point currents that travel transverse to the length of the line and permits lower r.f. currents to propagate along the length of the line. The resistive coating, and the gap size and spacing, control the ratio of loss in the operating band to the loss at the $\pi$ points. This results in increased cathode current focused at the collector electrode to improve output of the tube. Other objects and advantages will become apparent from the following description in conjunction with the accompanying drawings.

BRIEF DESCRIPTION OF THE DRAWINGS

FIG. 1 is a schematic perspective view of one half of a printed circuit traveling wave tube showing the internal multiple meanderline slow wave interaction structure and electrodes on a dielectric substrate;

FIG. 2 is a plot diagram of frequency versus phase shift for various circuit operating modes;

DESCRIPTION OF THE PREFERRED EMBODIMENT

Figure 3:
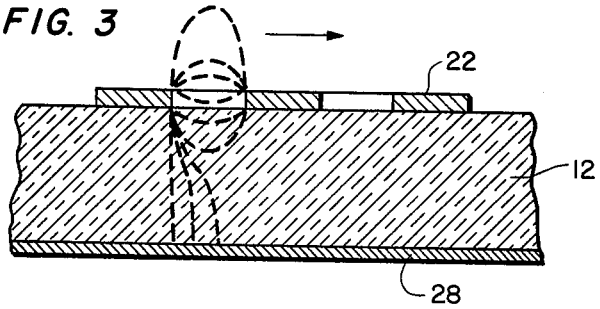
FIG. 3 is a schematic side cross-sectional view showing the electric field along a portion of a microstrip meanderline and ground plane.

As shown in FIG. 1, a printed circuit traveling wave tube 10 includes a pair of flat symmetrical substrate sheets 12, only the lower one of which is illustrated. The sheets are preferably of a suitable ceramic dielectric material such as alumina, which, when sealed to an intermediate ceramic ring or edge sealing frame 14, form a vacuum tight envelope for the tube components. Printed on the inner planar surface of substrate 12, in the form of flat conductive microstrip electrodes, are the collector electrode 16 across one end, longitudinal beam edge focusing electrodes 18, 20 along the opposing sides, a generally axial multiple meanderline slow wave interaction circuit strip 22, leads and connections to a source of potential, and a transverse beam forming electrode 24 at the other end. A transverse strip cathode 26 adjacent electrode 24 at the far end opposite the collector is the only electrode which is not printed as a microstrip line. Curved convoluted metal spacers 27 on the collector and along the edge focusing electrodes provide a desired spacing for assembly with the opposite mating ceramic sheet having like printed electrodes. On the bottom or outside of each substrate sheet is the ground plane conductor strip 28. A pair of periodic permanent magnets focusing sheets or slabs of a known type, not shown, are positioned over the outer surfaces and ground conductors of the upper and lower substrates 12 to focus a sheet beam of electrons from the cathode onto the collector electrode upon the application of suitable direct current potentials to the electrodes. The slow wave interaction meanderline applies desired radio frequencies to modulate and interact with the electron beam current.

FIG. 2 shows a family of curves representing different operating modes of an optimum four parallel circuit meanderline traveling wave tube, as a plot of frequency, f, (or $\omega = 2\pi f$) versus phase shift, $\beta$, or $\beta L/\pi$, where $L$ is the length of one period along the line. Curve 38 represents the symmetric fundamental mode which has the r.f. current of the four circuits in phase and has a fairly linear slope in the first region. This mode has the desired phase velocity for interaction with the electron beam. The optimum operating point for the tube is at the $\beta L/\pi = 0.6$ point of the fundamental mode in the 3–4 GHz frequency range. When $\beta L/\pi = 1$, which represents the $\pi$ point, or a phase shift of 180°, one period of the meanderline becomes one wavelength long. At this point, complete reflection of the radio frequency wave occurs. If the electron beam current is sufficiently high, the tube will oscillate at the $\pi$ point frequency. This also occurs at the like $\pi$ points of the curves 40, 34, 36, which are respectively the antisymmetric modes 1 and 2 and the backward wave mode, wherein the r.f. currents of the various circuits are in different phases. The oscillations cause defocusing of the electron beam and degradation of the tube performance.

Figure 4:
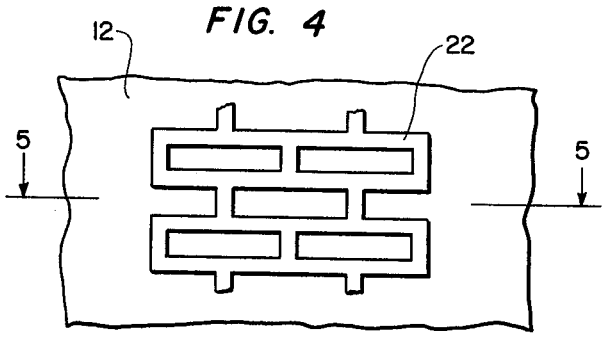
FIG. 4 is a top view of a portion of a multiple circuit meanderline on one ceramic sheet substrate.

FIG. 3 shows the electrical field in a longitudinal portion of the strip meanderline in the direction of transmission along the beam from cathode to collector, and FIG. 4 shows a top view of a portion of the four circuit meanderline. The electric field lines fringe between adjacent turns of the meanderline and through the dielectric material to the ground plane. R.f. current flows along the conductor line and ground plane in the direction of the propagation of the signal, indicated by the arrow. At lower radio frequencies and long wavelengths, there is little attenuation along the line. However, as noted, at the higher $\pi$ point frequencies, one period of the meanderline becomes one wavelength long, with the occurrence of a 180° phase shift and complete reflection. At this point, r.f. currents travel transverse to the length of the line and there is no propagation along the line. When current in the beam becomes sufficiently high, the tube will oscillate at the $\pi$ point frequencies of the various modes. Suitable attenuation can be made effective at these shorter wavelength frequencies without interaction of transverse currents with the beam.

Figure 5:
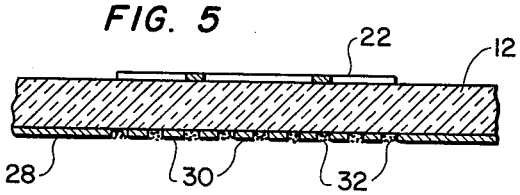
FIG. 5 is a front cross-sectional view of the meanderline and ground plane as seen along line 5—5 of FIG. 4.
Figure 6:
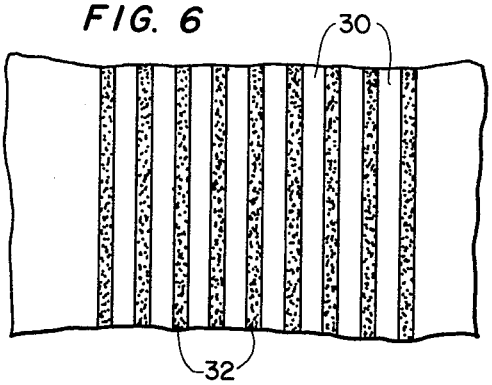
FIG. 6 is a bottom view of the ground plane of FIG. 5 showing the longitudinal gaps filled with a resistive coating on a portion of a ceramic substrate.

Suppression of the transverse currents and the $\pi$ point oscillation is accomplished by forming the ground plane 28, as shown in FIGS. 5 and 6, into an anisotropic plane. A plurality of parallel longitudinal gaps 30 are formed which permits r.f. current to propagate along the line, while preventing the flow of transverse current of higher $\pi$ point frequencies. A resistive coating 32, preferably of carbon particles, such as aquadag, are placed in the gaps to provide normal operation in the fundamental mode and a desired attenuation of the $\pi$ point r.f. currents. A sufficient number of gaps and coating density is applied to attenuate the $\pi$ point frequencies by about 20db or more while causing a loss of about 1db in the operating band. The gap width and number are selected for the $\pi$ point frequencies and control the ratio of loss in the operating band to loss at the $\pi$ points. In the illustrated circuit, operating in the 3.1–3.5 GHz range, having $\pi$ point modes of from 4.6–6 GHz, a gap of 0.040 inches provided optimum results, with a 10db gain at 1Kw power. About 9 gaps were employed spaced across the width of the parallel multiple meanderline circuit extending from the cathode to within 2–3 inches of the output electrode. Location of the resistance lines closer to the collector may result in excessive attenuation of the output. The width of the individual conductive electrode strips forming the meanderline is about 0.025 inches.

Before the application of oscillation suppression gaps, only about 500ma of beam current could be focused onto the collector out of 1700ma of cathode current, to provide a transmission of about 30 percent. After the gaps were formed, transmission to the collector was as high as 85 percent with no oscillation. Cold insertion loss of the tube with the beam off was 4db without oscillation suppression gaps and 6db with the gaps. Thus, the addition of the gaps adds only a small loss in the frequency band of the tube. While only a single embodiment has been illustrated and described, it is apparent that many variations may be made in the particular design and configuration without departing from the scope of the invention as set forth in the appended claims.

What is claimed is:

1. A microwave traveling wave tube comprising:

a pair of flat dielectric members defining a vacuum enclosure therebetween, means at one end of said enclosure for emitting an electron beam, means at the other end of said enclosure for collecting said electron beam, means for focusing said electron beam into a flat sheet beam between said emitting and collecting means, and microwave interaction circuit means disposed on at least one of said dielectric members and extending along said electron beam for applying microwave energy of a given frequency range to interact with said electron beam, said interaction circuit means including a planar multiple circuit strip meanderline disposed on the inner surface of said one dielectric member adjacent said electron beam and a ground plane conductor strip disposed on the opposite surface of said dielectric member, and oscillation suppression means disposed along said ground plane conductor strip for attenuating oscillations of selective microwave frequencies.

2. The device of claim 1 wherein said oscillation suppression means includes a plurality of longitudinal gaps extending along and spaced across said ground plane conductor, said gaps permitting microwave currents of a fundamental frequency to propagate in the longitudinal direction and blocking microwave currents of said selective frequencies in the transverse direction.

3. The device of claim 2 including resistive coatings in said gaps for attenuating said oscillations of selective frequencies.

4. The device of claim 3 wherein said resistive coatings include carbon particles.

5. The device of claim 3 wherein said dielectric members are of ceramic material, said means for emitting said electron beam includes a cathode, said means for collecting said beam includes a collector electrode, said focusing means includes a pair of periodic permanent magnet members positioned over opposite outer surfaces of said ceramic members, said collector electrode and said multiple circuit meanderline being in the form of printed conductive strips on the inner surfaces of each ceramic member and said ground plane conductor includes printed circuit conductor strips on said opposite outer surfaces of said ceramic members.

6. The device of claim 3 wherein the size and number of gaps are selected for optimum attenuation of oscillations at $\pi$ point frequencies and minimum attenuation of the fundamental frequency.

* * * * *